US008120481B2

(12) United States Patent
Gottlieb

(10) Patent No.: US 8,120,481 B2
(45) Date of Patent: Feb. 21, 2012

(54) EMERGENCY SERVICES NOTIFICATION STATION AND DOOR UNLOCK DEVICE

(76) Inventor: Mark Gottlieb, Fairfax Station, VA (US)

( * ) Notice: Subject to any disclaimer, the term of this patent is extended or adjusted under 35 U.S.C. 154(b) by 533 days.

(21) Appl. No.: 12/068,835

(22) Filed: Feb. 12, 2008

(65) Prior Publication Data

US 2009/0201147 A1 Aug. 13, 2009

(51) Int. Cl.
*G08B 1/08* (2006.01)

(52) U.S. Cl. ..... 340/539.12; 340/693.6; 340/532; 340/693.5; 340/539.1

(58) Field of Classification Search ..... 340/539.12
See application file for complete search history.

(56) References Cited

U.S. PATENT DOCUMENTS

| | | | | |
|---|---|---|---|---|
| 5,228,449 | A * | 7/1993 | Christ et al. | 600/504 |
| 6,468,263 | B1 * | 10/2002 | Fischell et al. | 604/890.1 |
| 6,579,231 | B1 * | 6/2003 | Phipps | 600/300 |
| 7,411,501 | B2 * | 8/2008 | Austin | 340/572.1 |
| 2003/0195567 | A1 * | 10/2003 | Jayne et al. | 607/5 |
| 2004/0075572 | A1 * | 4/2004 | Buschmann et al. | 340/691.1 |
| 2004/0124979 | A1 * | 7/2004 | Medema et al. | 340/539.18 |
| 2004/0128178 | A1 * | 7/2004 | Barrer | 705/8 |
| 2005/0148887 | A1 * | 7/2005 | Reiter et al. | 600/508 |
| 2006/0155336 | A1 * | 7/2006 | Heath | 607/5 |
| 2006/0202009 | A1 * | 9/2006 | Austin | 235/375 |
| 2007/0273504 | A1 * | 11/2007 | Tran | 340/539.12 |
| 2009/0063193 | A1 * | 3/2009 | Barton et al. | 705/3 |
| 2009/0201147 | A1 * | 8/2009 | Gottlieb | 340/539.12 |

* cited by examiner

*Primary Examiner* — Travis Hunnings
(74) *Attorney, Agent, or Firm* — Davidson Berquist Jackson & Gowdey, LLP

(57) ABSTRACT

When a person believes that he/she is having a heart attack, a pendant (or other communications device) can be activated to communicate an emergency services request signal to an emergency services notification station (e.g., that houses an AED). Once the emergency services notification station receives the emergency services request signal, the emergency services notification station can notify anyone in the area of the pending emergency (e.g., by sounding a siren and/or flashing a light and/or vibrating). The emergency services notification station can utilize an address display such that someone passing by is informed of the address of the person that needs assistance.

28 Claims, 5 Drawing Sheets

<table>
<tr><td>Receiving Circuitry For Emergency Services Request Signal</td><td>Unlocking Circuitry</td></tr>
<tr><td>Programming Interface Circuits</td><td>Address Translation Table</td></tr>
<tr><td colspan="2">Access Key Programmer/Printer</td></tr>
<tr><td colspan="2">Audio and/or Visual Indicator</td></tr>
<tr><td colspan="2">Display</td></tr>
</table>

Fig. 5

EMERGENCY SERVICES NOTIFICATION STATION AND DOOR UNLOCK DEVICE

FIELD OF INVENTION

The present disclosure is directed to the field of notifying passerbys that someone in the area is in need of emergency medical services, and in one embodiment to a system for requesting that an emergency medical device (e.g., an Automatic Electronic Defibrillator) housed in an emergency services notification station be brought to a person in need.

DISCUSSION OF THE BACKGROUND

Over 600,000 people in the USA die from cardiac arrest each year. Seventy percent of cardiac arrests are at home, often with someone other than the victim in the home.

Automatic Electronic Defibrillators (AEDs) are becoming a growing market as people are realizing the amount of lives that can be saved by the simple use of these devices. These devices are designed to be administered by anyone with or without training. The units walk the person through exactly what to do with voice prompts. Furthermore, the use of these devices falls under "Good Samaritan" laws which do not hold someone accountable who tries in good faith to administer aid—whether or not it is successful.

BRIEF DESCRIPTION OF THE DRAWINGS

The following description, given with respect to the attached drawings, may be better understood with reference to the non-limiting examples of the drawings, wherein:

FIG. 5 is a block diagram of various components that may be found within an emergency services notification station according to various configurations described herein

DISCUSSION OF THE PREFERRED EMBODIMENTS

With more and more elderly persons living longer and moving into apartments, independent living and assisted living communities, the need for AED devices increases. However, that need can only be met if the person needing assistance can be reached by a person willing to provide assistance. In order to provide such assistance, it may often be necessary to allow the person providing assistance to be allowed automatic entry into the home or apartment of the person requiring assistance. This can be achieved according to the methods and systems described herein.

Figure 1:
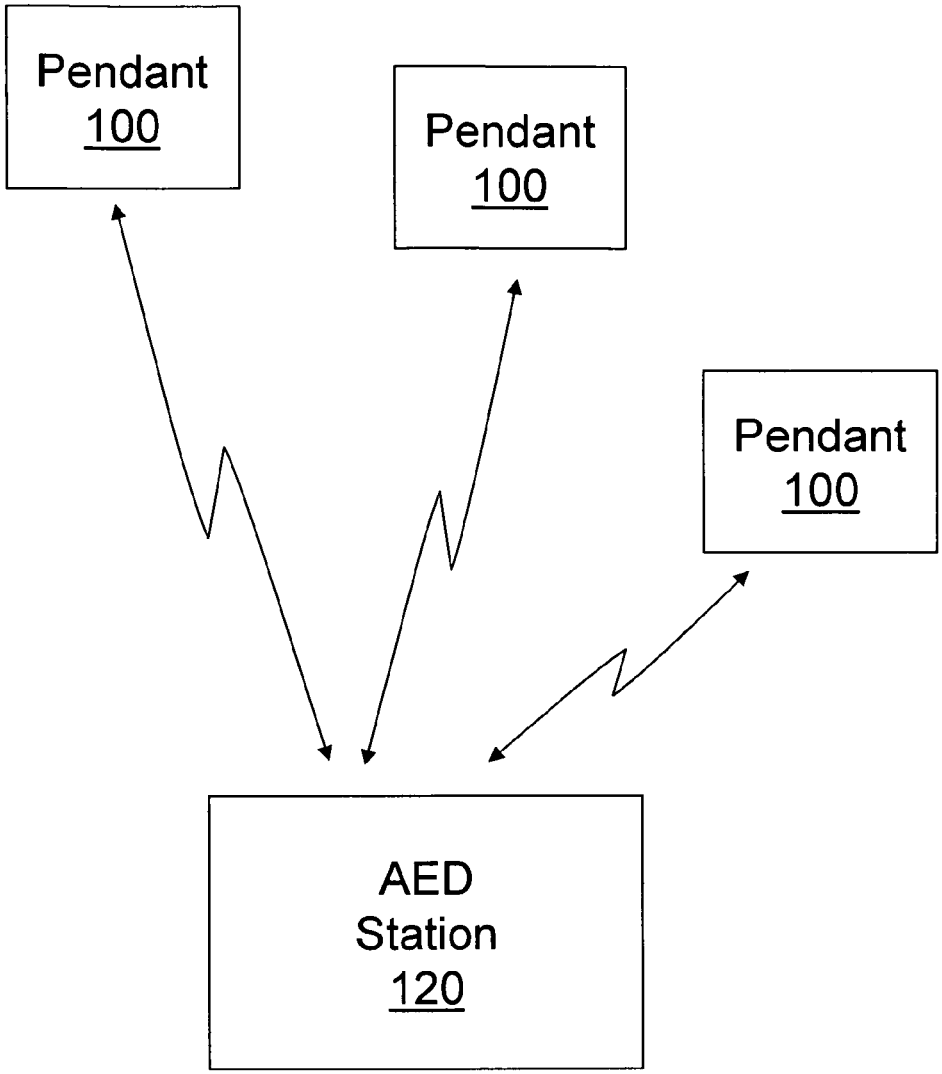
FIG. 1 is a block diagram of a system for requesting that emergency services be provided to a person in distress wherein the pendant and the emergency services notification station communicate directly.

Turning to FIG. 1, a pendant 100 can be worn by a person that may need emergency medical services (e.g. the use of an AED). For example, when that person believes that he/she is having a heart attack, the pendant 100 can be pressed to communicate an emergency services request signal to an emergency services notification station (e.g., AED station 120) that includes a housing 200 (FIG. 3) that houses a AED or other medical or emergency or safety equipment (e.g., a fire extinguisher) in a holding area (e.g., in a locked container). AED stations 120 may be glass front boxes hung on the wall of an apartment complex in the hallways or open areas of such a complex. Once the AED station receives the emergency services request signal, the AED station 120 can notify anyone in the area of the pending emergency (e.g., by sounding a siren and/or flashing a light 220 (FIG. 3) and/or vibrating) and unlock the housing. Alternatively, the AED station may have a housing the does not need to be unlocked but which has a glass front that needs to be broken to gain access to the AED.

Figure 2:
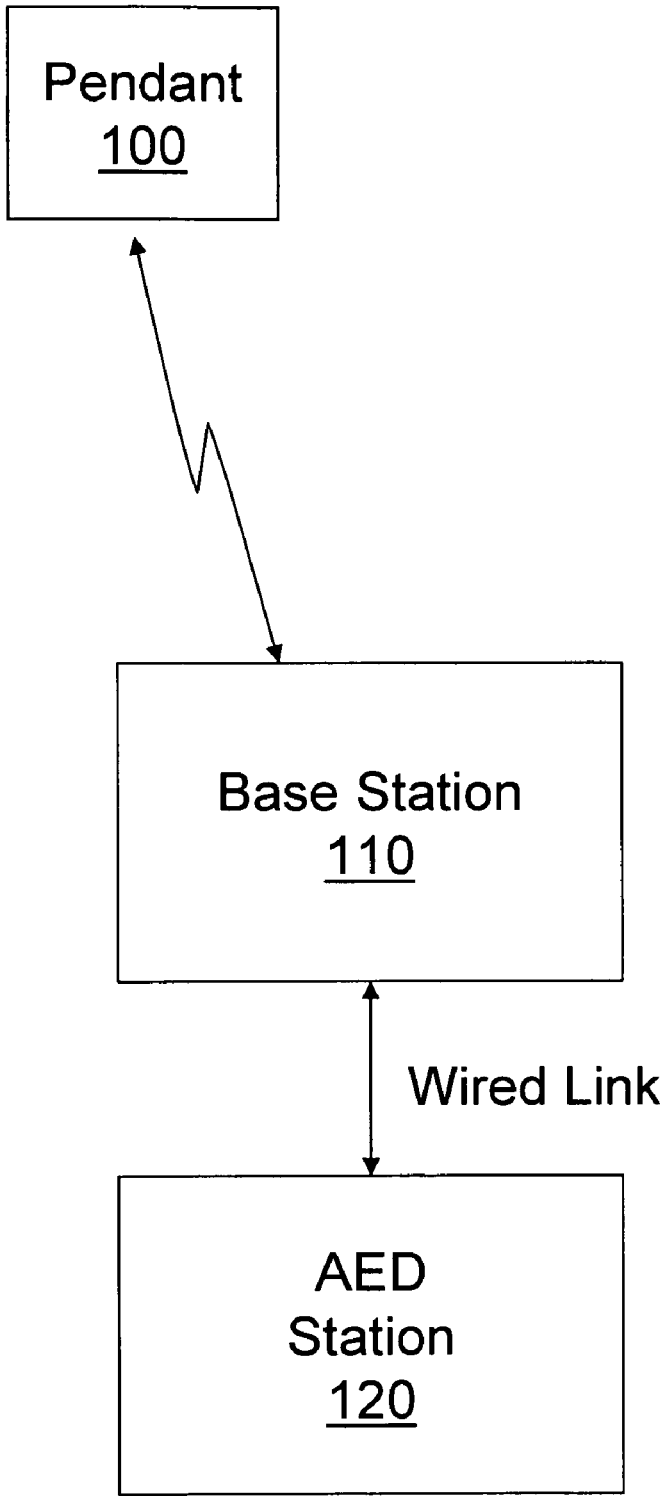
FIG. 2 is a block diagram of a system for requesting that emergency services be provided to a person in distress wherein the pendant and the emergency services notification station communicate through a base station.

As shown in FIG. 1, the emergency services request signal can be communicated to the AED station 120 from the pendant 100 using any kind of wireless radio signal (e.g., WiFi, cell phone). Alternatively, as shown in FIG. 2, the pendant may communicate with an intermediate device (e.g., base station 110) using a first communications protocol (e.g., WiFi, cell phone, Bluetooth) which then communicates with the AED station 120 using a second communications protocol over a wired connection (e.g., a standard telephone line or Ethernet cable to the box) or a wireless connection (e.g., WiFi or cell phone). The first and second communications protocols may be either different or the same.

Figure 3:
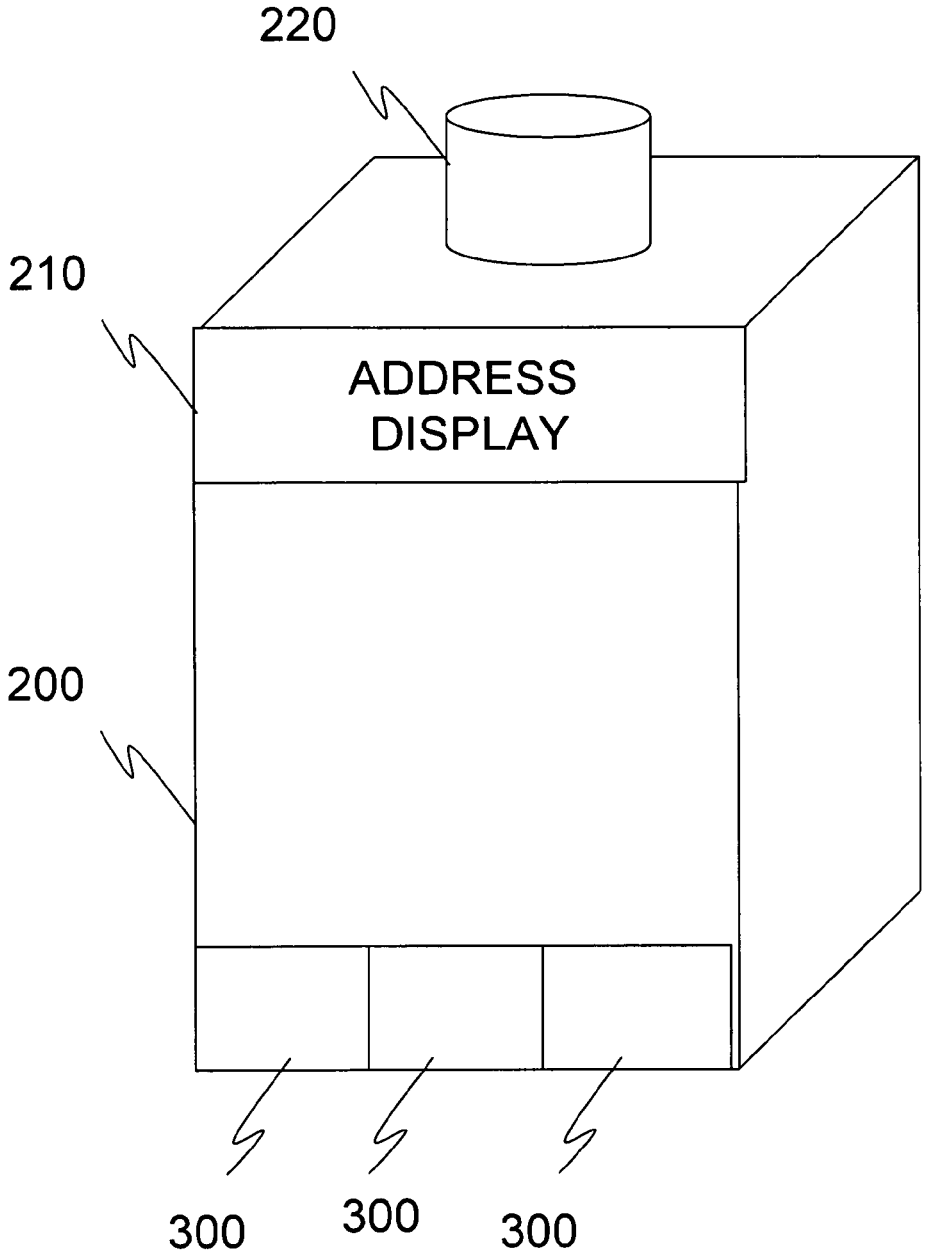
FIG. 3 is a conceptual diagram of an emergency services notification station including selectively unlocking drawers containing access keys.

In either configuration, the emergency services request signal is ultimately received by the AED station 120. The emergency services request signal may include a number of other parameters in addition to just the request for help. For example, the emergency services request signal may include a unique ID associated with the pendant 100 or the residence. The unique ID may be in any form that can be used by the AED station 120 to show where assistance is needed. For example, the unique ID may be a text string that represents the address (potentially including apartment number) associated with the pendant 100. This string can then be displayed on the address display 210 (FIG. 3). Alternatively, the unique ID could be just a number or character string that is translated by the AED station 120 into an address that can be displayed on the address display 210 such that someone passing by is informed of the address of the person that needs assistance. In such a configuration, the AED station 120 may be programmed from time to time with new or updated tables representing the translation from the number or character string to the address to be displayed. The updating or programming of the table may be performed locally (e.g., wirelessly or using a computer peripheral cable (e.g., a USB cable)) or remotely (e.g., across a telephone or cellular connection). The address translation table is preferably a non-volatile memory storage device (e.g., a flash memory) that can be read by a microprocessor or other controller within the AED station 120.

In embodiment, a location sensor (e.g., a GPS receiver) can be incorporated into the pendant 100 such that the emergency services request signal includes location information that can be used in more quickly locating the person in need of assistance. Such location information may be especially beneficial when the person in need of assistance is not at their normal residence or office which has been registered to the pendant.

In addition to having the AED station provide the location (e.g., address or apartment number) of the distressed person, in one embodiment the AED station also displays a lock-box code number as well on the display 210. (A lock-box is a device which hangs on the doorknob or is fixed to the door or wall around the door, and opens in response to a code to reveal a spare key which can in turn be used to open the door.

Lock-boxes are often used to allow real estate agents to enter houses that are being offered for sale.)

Thus, the person who shows up at the AED station 120 will see the apartment number and an unlock code for the lock-box on the door of the distressed person. This provides a method of entry as the distressed person is probably not in a condition to be able to answer the door. Alternatively, the AED station 120 may include a series of drawers (300 in FIG. 3) with a key of each registered user in a separate drawer. The unique drawer or compartment can be released under control of the system to allow the key to the apartment of the distressed person to be removed from the AED station 120.

The means for displaying the unlock information and/or the address information can be either a visual display, an audio output or a printout. A visual display (LCD, LED, CRT etc) could show the information. A print-out can be printed by printer at the AED station for the person to take with them as they carry the AED unit to the distressed person's apartment or residence. (Thus not requiring the person coming to the rescue to memorize the apartment number and the unlock code). Whether a visual or printed format—a diagram showing relative location and directions to the apartment could even be displayed or printed out. Alternatively, the AED station 120 can program the AED in the AED station with the information so that the person carrying the AED to the residence or apartment can carry the unlock code with him/her. That information can be displayed to the person on a display integrated with the AED or can be provided aurally to the person in the form of voice signals, such as the AED would provide to the person when connecting and/or using the AED on a person in distress. In yet another embodiment, when the lockbox and the AED are in close proximity, the AED itself can send a signal to the lockbox to unlock the lockbox such that the unlock code is never divulged to a person.

Figure 4:
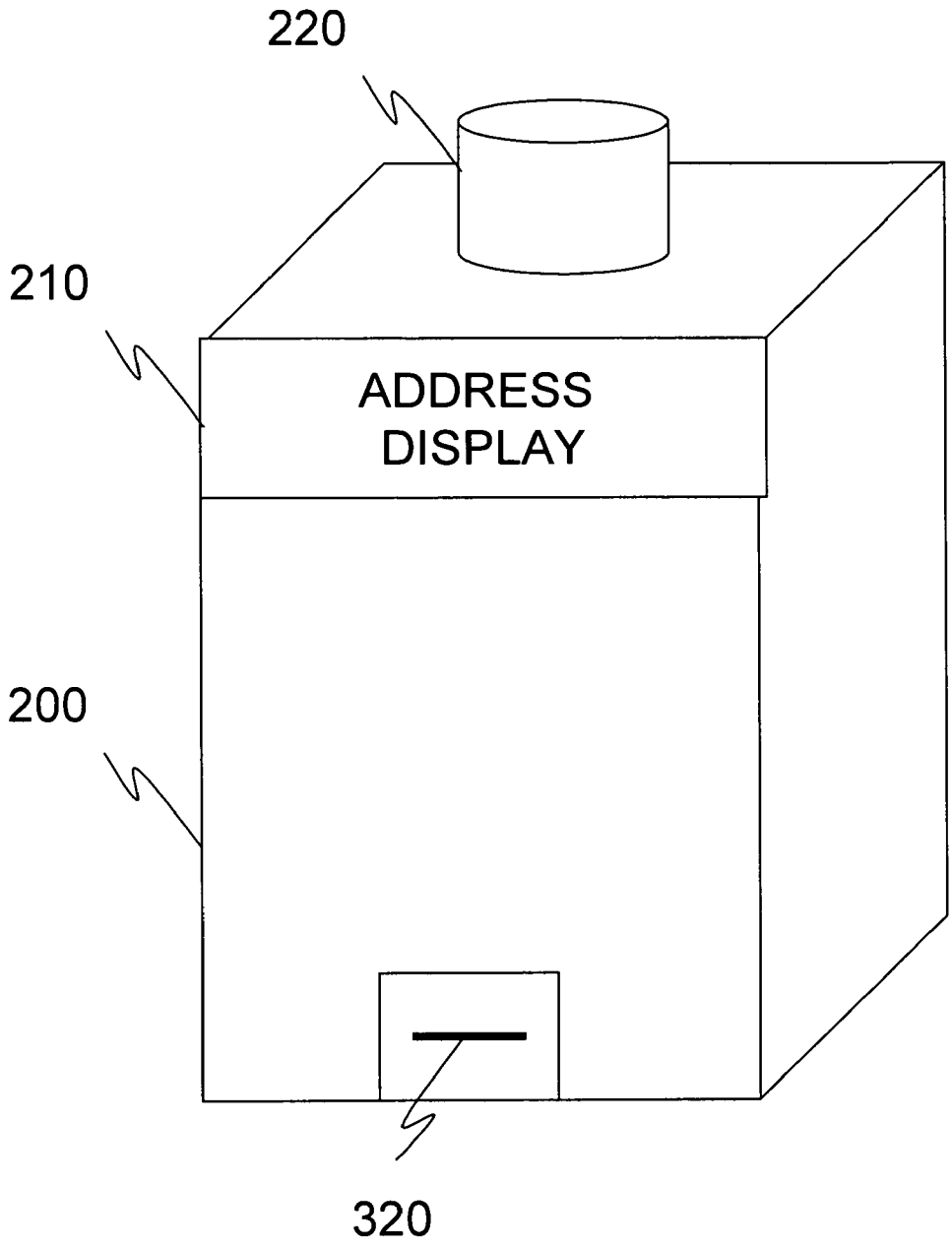
FIG. 4 is a conceptual diagram of an emergency services notification station including a slot for providing programmed access keys.

In yet another embodiment, the AED station 120 may program and/or dispense key cards which can be used to open the door and/or a lockbox for the door. For example, many doors in semi-public locations (e.g., hotel room doors) are equipped with locks that read plastic keys with holes, magnetic strips, smart cards (with and without contacts) and/or RFIDs that have been programmed (e.g., by the front desk when registering at a hotel). (As used herein, any of those keys and any physical key (e.g., metal key or IR or RFID-based key) may be referred to herein as an access key.) The same kinds of locks may be used on doors in apartment buildings, retirement homes, and other communities. In such environments, the AED station 120 need not have a set of drawers of keys, but instead may simply eject an access key from a slot (320 in FIG. 4) on one of the faces of the AED station 120. The access key may be programmed with temporary permissions (e.g., that will only open the corresponding door for 15 minutes).

In one embodiment of an AED station that programs and/or dispenses access keys, the AED station 120 is equipped with a slot for receiving an access key of a resident such that the AED station 120 has a record of who obtained the AED from the AED station 120. In addition, in such an environment, the AED station could read the access key of the person providing help and authorize that access key to open the door of the person in distress without having to reissue or reprogram any access keys. (The time for opening the door of the person in distress with the Good Samaritan's access key could likewise be limited to a short period of time (e.g., 15 minutes)). In addition, biometric information can be used to identify the Good Samaritan to the AED station 120 such that the same biometric information (or other biometric information accessed after having provided the first biometric information) can be used to open the door of the person in distress. Such biometric information may be obtained using any biometric reader (e.g., fingerprint reader, IRIS reader, palm reader, and/or voice recognition). (The biometric information is also referred to herein as an access key.)

In yet another configuration, the pendant 100 or base station 110 may include a transmitter that sends a signal to the lockbox to unlock the lockbox such that the person providing assistance need not have to enter the code or know to place the AED in close proximity to the lockbox.

In a configuration in which the pendant 100 or base station 110 can communicate with the lockbox, the lockbox can be configured to provide an audio and/or visual indication of the location of the lockbox (and therefore the person in distress). Such an indication may be in the form of a flashing light and/or audible alarm sound that triggers when this unlock event is triggered and/or the emergency services request signal is transmitted. This increases the likelihood of the residence or apartment being found.

In yet another embodiment, the unlocking function can be integrated into the door itself—i.e., using an electronic lock—such that the door can be opened remotely upon activation of the pendant 100.

While the above discussion has centered primarily on pendants 100, other communication devices may also be used to trigger an alert on an emergency services notification station and/or the door unlocking mechanism. For example, sensors (e.g., smoke and/or fire detectors) or personal emergency response panic buttons can be used to trigger the same door unlock or lockbox systems. So, if there is a fire in an apartment, or if the person in the apartment pushes their panic button—a box located in a hallway or other central location—could display the location information and unlock code for the lock-box.

In alternate embodiments, the station may include one or more holding areas containing at least one of diabetes medication, an oxygen mask, a fire extinguisher, a stretcher, a tourniquet, medicine for allergic reactions (e.g., epinephrine), anti-poison medicine, a stomach pump, medicine to induce vomiting, eye wash, anti-seizure medicine and/or equipment, IVs, a fireman's axe, a door frame spreader, or any other equipment to be used prior to the arrival of or in the aid of emergency and/or safety personnel. Any of those items are referred to herein as "equipment".

In addition, the unlock mechanism could be triggered by a call to an emergency services provider (e.g., 911). The base station 110 could be interposed between the telephone handset and the wall jack such that when a call to 911 is made the lockbox or door unlock mechanism is activated, thereby allowing emergency services personnel to enter the residence or apartment without needing to break down the door. They likewise would be better able to find the apartment or residence if the lockbox audio/visual indications are provided.

While certain configurations of structures have been illustrated for the purposes of presenting the basic structures of the present invention, one of ordinary skill in the art will appreciate that other variations are possible which would still fall within the scope of the appended claims.

The invention claimed is:

1. An emergency services notification station configured to be mounted in a hallway of outside of the apartments in an apartment building comprising:

circuitry for receiving an emergency services request signal from a transmitter associated with a requester of emergency services corresponding to one of the apartments;

a housing configured to be mounted in the hallway of an apartment building, the housing including at least one of an audio indicator and a visual indicator for indicating that the emergency services request signal has been received;

a display for displaying an apartment number corresponding to the requester of the emergency services; and an equipment holding area for holding a piece of equipment to be used in the aid of the requester of the emergency services prior to arrival of at least one of emergency personnel and safety personnel.

2. The emergency services notification station as claimed in claim 1, wherein the emergency services request signal comprises the address corresponding to the requester of the emergency services.

3. The emergency services notification station as claimed in claim 1, further comprising an address translation table, wherein the emergency services request signal comprises an identification signal that is translated by the address translation table into the address corresponding to the requester of the emergency services.

4. The emergency services notification station as claimed in claim 1, wherein the piece of equipment comprises a piece of medical equipment.

5. The emergency services notification station as claimed in claim 4, wherein the piece of medical equipment comprises an Automatic Electronic Defibrillator (AED).

6. The emergency services notification station as claimed in claim 4, further comprising a programming interface for programming the piece of medical equipment with an address corresponding to the requester of the emergency services when the piece of medical equipment is held in the medical equipment holding area.

7. The emergency services notification station as claimed in claim 6, wherein the programming interface comprises an interface for programming information to be displayed on a display integrated into the piece of medical equipment, the information including the address of the one of the apartments.

8. The emergency services notification station as claimed in claim 6, wherein the programming interface comprises an interface for programming a voice message to be played from a speaker integrated into the piece of medical equipment, the voice message including the address of the one of the apartments.

9. The emergency services notification station as claimed in claim 4, wherein the emergency services request signal comprises a request for medical services provided by the piece of medical equipment.

10. The emergency services notification station as claimed in claim 1, wherein the display further displays an unlock code of a locking mechanism associated with the one of the apartments corresponding to the requester of the emergency services.

11. The emergency services notification station as claimed in claim 10, wherein the locking mechanism comprises a lockbox.

12. The emergency services notification station as claimed in claim 10, wherein the locking mechanism comprises a locking mechanism integrated into the door associated with the one of the apartments corresponding to the requester of the emergency services.

13. The emergency services notification station as claimed in claim 1, wherein the circuitry for receiving an emergency services request signal comprises a WiFi interface.

14. The emergency services notification station as claimed in claim 1, wherein the circuitry for receiving an emergency services request signal comprises a telephone interface.

15. The emergency services notification station as claimed in claim 1, wherein the circuitry for receiving an emergency services request signal comprises a PSTN interface.

16. The emergency services notification station as claimed in claim 1, wherein the circuitry for receiving an emergency services request signal comprises a cellular interface.

17. The emergency services notification station as claimed in claim 1, wherein the circuitry for receiving an emergency services request signal comprises an Ethernet interface.

18. The emergency services notification station as claimed in claim 1, wherein the circuitry for receiving an emergency services request signal comprises circuitry for receiving a signal from a base station.

19. The emergency services notification station as claimed in claim 1, wherein the circuitry for receiving an emergency services request signal comprises circuitry for receiving a signal from a pendant.

20. The emergency services notification station as claimed in claim 1, further comprising a printer for printing an unlock code of a locking mechanism associated with the one of the apartments corresponding to the requester of the emergency services.

21. The emergency services notification station as claimed in claim 1, wherein the emergency services request signal comprises a request for medical services.

22. The emergency services notification station as claimed in claim 1, wherein the emergency services request signal comprises a request from at least one of a fire detector and a smoke detector.

23. The emergency services notification station as claimed in claim 1, further comprising circuitry for transmitting a request to unlock a door corresponding to the emergency services request signal.

24. The emergency services notification station as claimed in claim 1, further comprising a set of drawers for providing access keys corresponding to registered requesters of the emergency services.

25. The emergency services notification station as claimed in claim 1, further comprising an access key programmer for programming an access key corresponding to a locking mechanism associated with the one of the apartments corresponding to the requester of the emergency services.

26. The emergency services notification station as claimed in claim 1, further comprising an access key reader for determining an identity of the person responding to the emergency services request signal.

27. The emergency services notification station as claimed in claim 1, wherein the emergency services request signal comprises location information about the location of the requester of the emergency services.

28. The emergency services notification station as claimed in claim 27, wherein the location information comprises GPS location information.

* * * * *